US008926319B2

(12) United States Patent
Franz et al.

(10) Patent No.: US 8,926,319 B2
(45) Date of Patent: Jan. 6, 2015

(54) DEVICE FOR BURNING A FUEL/OXIDANT MIXTURE

(75) Inventors: Marcus Franz, Schwabmünchen (DE); Sören Götz, Rain (DE)

(73) Assignee: SGL Carbon SE, Wiesbaden (DE)

( * ) Notice: Subject to any disclaimer, the term of this patent is extended or adjusted under 35 U.S.C. 154(b) by 920 days.

(21) Appl. No.: 13/069,133

(22) Filed: Mar. 22, 2011

(65) Prior Publication Data

US 2011/0229835 A1 Sep. 22, 2011

Related U.S. Application Data

(63) Continuation of application No. PCT/EP2009/062215, filed on Sep. 21, 2009.

(30) Foreign Application Priority Data

Sep. 22, 2008 (DE) ..... 10 2008 048 359

(51) Int. Cl.
*F23D 14/46* (2006.01)
*F23C 99/00* (2006.01)

(52) U.S. Cl.
CPC ..... *F23C 99/006* (2013.01)
USPC ..... 431/170; 431/7; 431/326; 431/327

(58) Field of Classification Search
CPC ... F23D 14/16; F23D 2203/105; F23C 13/00; F23C 99/006
USPC ..... 431/170, 7, 326, 327
See application file for complete search history.

(56) References Cited

U.S. PATENT DOCUMENTS

| | | | | | |
|---|---|---|---|---|---|
| 4,392,814 | A | * | 7/1983 | Harding | 431/170 |
| 4,785,768 | A | * | 11/1988 | Brown et al. | 122/4 D |
| 5,165,884 | A | * | 11/1992 | Martin et al. | 431/7 |
| 5,320,518 | A | | 6/1994 | Stilger et al. | |
| 5,522,723 | A | * | 6/1996 | Durst et al. | 431/328 |

FOREIGN PATENT DOCUMENTS

| | | | |
|---|---|---|---|
| DE | 4322109 | A1 | 1/1995 |
| DE | 19527583 | A1 | 1/1997 |
| DE | 19729718 | A1 | 5/1998 |
| DE | 199 39 951 | A1 | 3/2001 |
| EP | 1918640 | A2 | 5/2008 |

OTHER PUBLICATIONS

International Search Report for PCT/EP2009/062215 dated Apr. 12, 2010. (8 pages).

* cited by examiner

*Primary Examiner* — Avinash Savani
(74) *Attorney, Agent, or Firm* — Taylor IP, P.C.

(57) ABSTRACT

A device for burning a fuel/oxidant mixture in a strongly exothermic reaction, consists of a reactor with a combustion chamber containing at least one first porous material and at least one second porous material in separate zones A and C. The zones are designed in such a way that an exothermic reaction can only occur in zone B, and with one or more feed lines for the fuel and for the oxidant, whereby zone A, which consists of the first porous material, is separated by a distance of approximately 10 mm to 4000 mm, for example approximately 20 mm to 500 mm, equating to one zone B, from zone C which consists of the second porous material and is located before zone C in a flow direction of the fuel/oxidant mixture.

13 Claims, 1 Drawing Sheet

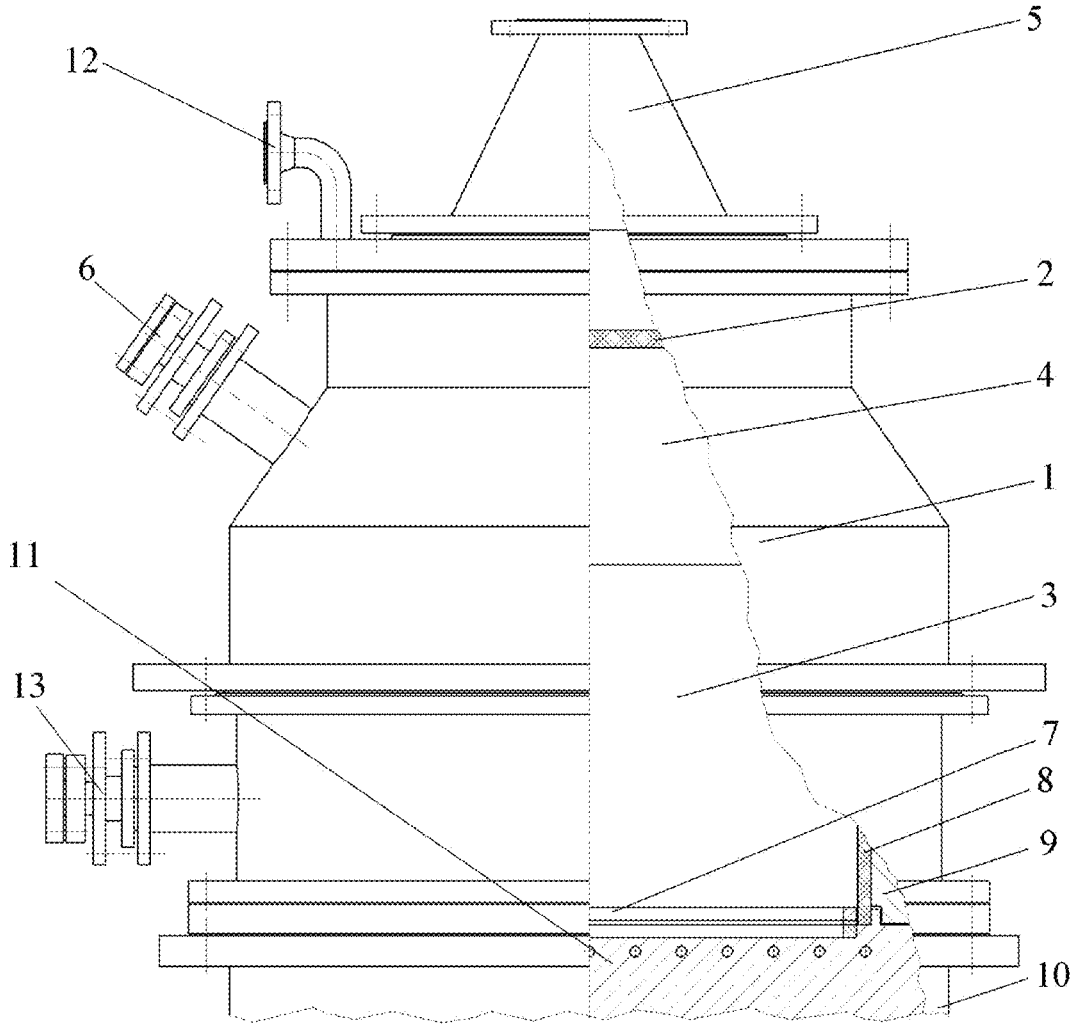
5
12
6
2
4
1
11
3
13
7
8
9
10

DEVICE FOR BURNING A FUEL/OXIDANT MIXTURE

CROSS REFERENCE TO RELATED APPLICATIONS

This is a continuation of PCT application No. PCT/EP2009/062215, entitled "DEVICE FOR BURNING A FUEL/OXIDANT MIXTURE", filed Sep. 21, 2009, which is incorporated herein by reference.

BACKGROUND OF THE INVENTION

1. Field of the Invention

The present invention relates to a device for burning a fuel/oxidant mixture in a strongly exothermic reaction, the device including a reactor with a combustion chamber containing at least one first porous material and at least one second porous material in separate zones, whereby the zones are designed in such a way that an exothermic reaction can only occur in the second zone, and with one or more feed lines for the fuel and for the oxidant.

2. Description of the Related Art

Documents DE 43 22 109 C2 and DE 199 39 951 C2 describe devices which are designed as so-called porous burners. The combustible gas mixture initially flows through one region, which is referred to as zone A and which has sufficiently small effective pore diameters so as to not allow stationary flame spreading. In other words, the first porous zone is operationally similar to a flame arrester. The following actual combustion region, which is referred to as zone C, has greater pore sizes which are large enough to permit a stationary burning. A critical Péclet number of Pe>65 is cited in technical literature (for example Babkin, et al., in "Combustion and Flame, Vol. 89, pages 182-190, 1991) as criterion for the spreading of flames in the interior of a porous matrix.

Materials such as aluminum oxide, zircon oxide, silicon carbide, etc., which in addition to high temperature resistance, also possess sufficient corrosion resistance, can be used as porous combustion chamber filling in porous reactors for chemical industrial plants. To produce a porous combustion chamber, bulk material of temperature resistant ceramic balls, saddle packing or similar bodies are used, as are preferably used for example as random packing for thermal separation processes. Bulk materials are preferred because they allow easy clean-up of deposits, for example of salt residues which occur in hydrogen chloride synthesis, originating from the combustion gases. According to DE 43 22 109 C, in porous burners, zones of different pore structure or respectively pore size are arranged in order to produce hydrogen chloride zones. This is done by using filler bodies of different sizes for zones A and C. In addition, structured packing and foams may be used in zones A and B.

According to document DE 199 39 951 C2, an additional support grate can be arranged between the porous structures formed by filler bodies in the two zones and having different pore sizes. The support grate prevents the discharge of smaller sized filler bodies from zone A into the inter-spaces of the larger filler bodies in zone C. In burners where gases do not exit vertically, or in an upward direction, another gas-permeable grate is arranged at the gas exit from zone C which closes the combustion chamber. As a result, it is possible to arrange the reactor in any random position despite the loose bulk of filling bodies in the combustion chamber.

The porous reaction chamber is preferably encased by a corrosion resistant cooled wall which consists, for example, of artificial resin-impregnated graphite. Cooling can be effected through cooling water, air or by the combustion gases themselves. Between the cooled wall and the combustion chamber is then preferably located an insulating intermediate layer of high temperature resistant, corrosion resistant and thermally insulating materials, which prevent loss of heat and which ensure that the desired combustion chamber temperature prevails at each location in the combustion chamber. According to the document DE 199 39 951 C2, this heavy insulation permits an almost adiabatic process control without any temperature influence on the combustion process as a result of the cooled wall. The adiabatic process control permits, for example, simple scale-up of such chemical reactors since heat transport properties are irrelevant to the cooled walls and the entire process in a flow direction can be regarded as almost one-dimensional.

In a porous reactor the reaction is conducted inside a porous matrix consisting of temperature resistant material. In deviating from conventional reactor devices it is not necessary to arrange the reactor in a voluminous combustion chamber or to locate such downstream. From the reactor itself, the hot reaction products flow without direct flame formation. In DE 43 22 109 C2 it is suggested to use a clearly lower Péclet number for the first zone, and a clearly higher Péclet number for the combustion zone than the critical Péclet number of Pe=65.

When the porous reactor is being ignited, the combustion stabilizes at the interface between the two zones. Due to the smaller pore dimensions in the first zone no combustion occurs in this region in a stationary state, only pre-heating of the gas mixture. This characteristic also fulfills the most stringent safety regulations with regard to the danger of flashback in chemical plants.

Due to the excellent heat transfer between gas and solid phases inside the porous matrix, they are in approximate thermal balance. The approximate thermal balance between gas and solid phases and the intensive blending inside the pore body essentially causes the disappearance of free flames in the combustion zone which is equipped with larger pores. The burning process is now performed in an extended reaction area which can be classified as a combustion reactor, rather than combustion chamber with free flames. According to document DE 199 39 951 C2 the pre-mixing chamber is part of and a safety relevant component of the described device.

A disadvantage of the existing construction forms exists in the locally restricted temperature acquisition by means of thermo-elements in the reaction zone. A further disadvantage of known porous reactors whose porous layers are made up of bulk material consists in that the bulk material bodies are carried along by the gas flow in the case of a higher or suddenly increased gas throughput, thereby leading to changes in the bulk material density as well as in the Péclet number. A stable process control under greatly changing gas throughput conditions, especially for controlled burning of larger volumes of halogenated gases during abnormal occurrences, is possible only to a very limited extent.

What is needed in the art is a reactor which permits the exothermic chemical reaction of a fuel/oxidant mixture while providing a stable process control under changing gas throughput conditions.

SUMMARY OF THE INVENTION

The present invention provides a device configured for burning a fuel/oxidant mixture in a strongly exothermic reaction. The device includes a reactor with a combustion chamber containing at least one first porous material and at least one second porous material in separate zones, whereby the zones are designed in such a way that an exothermic reaction can only occur in the second zone. The device further includes one or more feed lines for the fuel and for the oxidant. Zone A, which consists of the first porous material, is separated by a distance of approximately 10 mm to 4000 mm, for example approximately 20 mm to 500 mm, equating to one zone B, from zone C which consists of the second porous material and is located before zone C in flow direction of the fuel/oxidant mixture.

A first embodiment of the device of the present invention provides that the combustion chamber and the porous materials consist of materials which are resistant to temperatures from approximately 1000° C. to 2400° C. A temperature monitoring device and an ignition device may, for example, be arranged in zone B. The temperature monitoring device is, for example, an infrared sensor which captures a range of approximately 2 to 200 $cm^2$ at the interface with zone C. An acquisition beyond the cited range is not possible according to the current state of the art.

A second embodiment of the device according to the present invention provides that it is arranged vertically and that zone A is located above zones B and C. The bulk material of zones A and C are arranged on support grates. Loosening or swirling up of the bulk material and a change in the flow resistance, and thereby the Péclet-number, is prevented by the dead weight of the bulk material bodies and the support grates. In addition, loosening of the bulk layer is, in principle, avoided by locating zone A above zone C since, the bulk material C is pressed against the support grate in direction of gravitation.

According to a third embodiment of the present invention, a method is provided such that the fuel/oxidant mixture and the additionally supplied gas are blended at least partially in a premixing device which is located upstream from the reactor. A relevant device according to this embodiment consists in that it includes a pre-mixing chamber for the fuel/oxidant mixture from where this fuel/oxidant mixture flows into the combustion chamber. The pre-mixing chamber located here enables a substantially better blending and a more effective conversion of the reactants which, for example, allows a reduction of the required methane component during the hydrogen chloride synthesis.

A fourth embodiment of the present invention provides that the premixing chamber is designed so that the component of the mixture's flow speed in the premixing chamber in relation to the direction of the combustion chamber is greater than the flame speed in the combustion chamber. The premixing chamber is thereby dimensioned so that a flame which may possibly occur in the premixing chamber is blown out in the event of an unintentional ignition in the entire operating area, for example during start-up. Means of cooling may also be provided in the premixing chamber to further aid in prevention/extinguishing unintentional ignition. A porous material with interconnected cavities, sufficient and large enough for flame development may be provided in the combustion chamber. In particular, the porosity of the porous material with interconnected cavities changes in the direction of the flame development into larger pores, whereby a critical Péclet number results for the size of pores at one interior contact surface, above which the flame development occurs and below which it is suppressed. Combustion stabilization is achieved through the increase in the size of pores in the flow direction, whereby a critical Péclet number for the size of pores results in one zone of the porous material, above which the flame development occurs and below which it is suppressed.

Application of this technology for the production of chemical products, such as for example hydrogen chloride, or for the afterburning of pollution gases, for example halogenated gases, not only affects the combustion positively but also allows the line components in which the pore reactor is integrated to be designed and arranged advantageously.

The premixing chamber is constructed, for example, of corrosion resistant materials, for example of artificial resin-impregnated graphite. Enamel or fluorocarbon resin-lined steel components can also be used to build a mixing chamber. From the premixing chamber, the premixed gases may penetrate through a grate of corrosion resistant material, for example silicon-carbide, aluminum-oxide, or others, into zone A of the porous reactor. As previously discussed, several chemical reactants such as chlorine and methane are suitable under the influence of UV-radiation for self-ignition. However, self-ignition in the premixing chamber should be avoided for safety reasons. A grate and the layout of zone A are selected so that no or very little UV-radiation reaches from zone A, or respectively C, into the premixing chamber which could cause ignition of the gas mixture of chlorine and methane.

The stability of the combustion in the described porous reactor is to be especially emphasized. In contrast to the hydrogen chloride reactors which are constructed according to the current state of the art and which react very sensitively to pressure and volume fluctuations of the gases, whereby therefore the flame can easily extinguish, the combustion reaction in the porous reactor is immediately reignited through the heat capacity of the filler bodies in zone C, even during a short-term interruption of the gases. However, for safety reasons it is advisable to turn off the other gas during an outage of one of the gases, and to connect an inert gas flushing. Even after several minutes the reactor can then be operated again, without a renewed start-up procedure, even after an inert gas flushing.

Ignition and preheating of the reactor can occur with a fuel gas (hydrogen, methane, or others) and air. A conventional ignition device which is customary for such chemical reactors can be used. After completely heating zone C, changeover to the reactants, for example chlorine, methane and air, can occur gradually or immediately. Sudden load fluctuations up to 50% of the rated load which can occur in this type of equipment can be controlled without difficulty in the described pore reactors.

Due to the technology for dimensioning of pore reactors, scaling-up for technical lines, especially with the previously described adiabatic process control according to which defined flow conditions are adhered to in zones A and C, independent of the equipment size, becomes surprisingly simple.

The porous reactors which are described below, and are modified for chemical processes are parts of process technological equipment for the production of hydrochloric acid or for after-burning of halogenated, for example, chloride containing compounds. Equipment of this type includes, for example, a modified porous reactor, a heat exchanger for cooling of the reaction products, or respectively for utilization of their heat content and, depending on the type of equipment, an absorber, scrubber or waste gas scrubber at transition pieces between the units, pumps, pipe lines and the usual safety, measuring and control devices. Because of the reaction control and the efficient blending of the gases in the porous reactor a voluminous combustion chamber is not necessary in contrast to the current state of the art. The reactor can be directly connected to the downstream equipment, for example to a heat exchanger, a quencher with absorber or other equipment. After the reaction products flowing from the reactor have been cooled in a heat exchanger or after a quencher, a partial flow of the cooled gases or gas mixtures are again supplied to the reactor, as previously described. Alternatively, as described, another gas, for example water vapor can be added.

Depending upon the requirements for the product, only parts of the process technological equipment may be required, for example the reactor and gas cooler or reactor and quencher, depending upon whether the product is required in a gaseous form or dissolved in water as hydrochloric acid.

An additional design form of a line for the production of hydrogen chloride uses carbureted hydrogen gases as a hydrogen supplier, for example natural gas, methane, propane, etc., chlorine and air. Combustion occurs according to the greatly simplified illustration of the reaction equations (1) and (2):

$$CH_4+O_2+Cl_2 \rightarrow CO+2HCl+H_2O \quad (1),$$

$$CO+1/2O_2 \rightarrow CO_2 \quad (2).$$

This burning is difficult to control in lines according to the current state of the art since with unfavorable marginal conditions soot can occur, thus contaminating the equipment line and the acid. The described special properties of the porous reactor unexpectedly permit a stable, soot-free burning, also for this critical application.

Porous reactors for after-burning of halogenated waste gases or vaporizable or gaseous, halogenated compounds are designed so that oxidants and fuel gas may be blown into the premixing chamber in a premixed state. In zone C, a stable support flame is produced by the high reaction enthalpy of oxidant and fuel gas. The gas or gas mixture that is to be subject to after-burning is blown into the premixing chamber through a supply pipe, for example, over a support grate before zone A of the porous reactor, and mixed with the fuel/oxidant mixture. For temperature control of the after-burning process an appropriate surplus of the oxidant, for example air, may be used. To control the temperature in zone C of the porous reactor, the temperature is measured, for example, by means of an infrared pyrometer, and the signal processed for the purpose of oxidant control. The following devices differ during after-burning from the line components described above, depending on the halogen content, of the waste gases. At a low halogen content, where the fabrication of hydrochloric acid is not in the foreground, only a quencher and a washer are generally located downstream. Other escort substances, for example sulfur compounds or similar, can also be subjected to a harmless removal in the described devices. In principle, this applies also for halogenated or sulfurous vaporizable pure substances or mixtures. Since the described after burner equipment lines with porous reactor do not require a combustion chamber in the conventional sense, lines of this type can be arranged very compact and cost effective.

Based on the detailed descriptions outlined above, the following embodiments of the present invention are feasible:

- the combustion chamber may have at least two zones with material of different pore size, between which the pore size provides the critical Péclet number;
- the material with the interconnected cavities may have, at least partially, a bulk deposit of bodies, such as are utilized for solid bodies bulk materials or controlled packing during thermal separation processes, such as balls or saddle packing;
- at the interface for zones of different porosity a grate, like a support grate may be provided in order to prevent discharge of the bodies from one zone into the other zone, whereby the grate, for example the support grate, can also be cooled;
- the combustion chamber is designed for flame stability during overpressure and negative pressure;
- all, or only some of the supplied product gases are preheated in order to avoid condensing in the premixing chamber after adding cooling vapors, for example water vapor (condensed components would greatly deteriorate the reaction success and would lead to undesirable by-products);
- the premixing chamber may not be cooled, but its walls targeted to be kept above the temperature of the dew point of the gas mixture, in order to prevent condensing of gas components.

The combustion chamber can now also be designed for flame stability during overpressure and negative pressure which, in the known state of the art, would have resulted only in insufficient flame stability. On the basis of the present invention and its further developments however, a substantially greater pressure range is available, so that an appropriate design for a large pressure range in a manner known to the expert, for example for overpressure or negative pressure, can lead to a substantial increase in flame stability. Control systems can to a large extent be eliminated.

A further embodiment of the present invention provides a combustion chamber insulation for an approximate adiabatic burning control without wall effects. An adiabatic combustion process is especially advantageous in increasing the conversion rate.

In addition to the burning it is also possible to gain reaction products, for example during hydrogen chloride burning for the hydrogen chloride synthesis. Here, the present invention further provides that the apparatus includes a device for the extraction or separation of reaction products from the burned fuel/oxidant. Especially for the hydrogen chloride synthesis it is provided that the device is designed for a chlorinated compound in the fuel, as well as methane in the oxidant in order to burn the hydrogen chloride and includes a process technological unit after the combustion chamber for extraction of hydrogen chloride or hydrochloric acid. It is to be remarked, in particular, that the appropriate safety devices are considered and that the materials are accordingly corrosion resistant.

The present invention is not only suitable for burning and for hydrogen chloride synthesis, but also as a device for after-burning of waste gases and, in this context, for cleaning. Therefore, problem-free after-burning of components of chlorinated, organic compounds and thereby harmless disposal thereof is possible with the device according to the present invention.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein:

FIG. 1 is a partial illustration of a porous reactor line.

Corresponding reference characters indicate corresponding parts throughout the several views. The exemplification set out herein illustrates one embodiment of the invention, (in one form), and such exemplification is not to be construed as limiting the scope of the invention in any manner.

DETAILED DESCRIPTION OF THE INVENTION

Referring now to the drawings, and more particularly to FIG. 1, there is shown porous reactor 1. The essential characteristic of the present invention consists in that the flame is cooled through addition of an additional gas to the fuel/oxidant mixture which can be realized in all conceivable reactor types. Therefore, the following description of the design example merely on the bases of porous reactor 1 is not to be regarded as a limitation. The housing of porous reactor 1 consists of thin-walled, high temperature resistant ceramic interior lining 8, for example oxide ceramic, with a thickness of approximately 2 mm to 50 mm, graphite support casing 9 and outside steel casing 10 located at a distance from it. Between graphite support casing 9 and steel casing 10, cooling water is guided which leaves porous reactor 1 at connection piece 12. In addition, defined zones A-2, zone B-4 and zone C-3 are shown. Zone C-3 is the zone in which burning occurs. Ignition is avoided in zone A-2 by means of appropriate dimensioning. Zone C-3 is filled with fillers for this purpose. Zone A-2, in contrast, is filled with porous bodies which function as a flame arrester. Zone A-2 and zone C-3 are distanced from each other by zone B-4. The wide-coverage temperature monitoring occurs at the interface between zone B-4 and zone C-3 by means of access of a temperature sensor in the thermometer connecting piece. The gas mixture is led into porous reactor 1 from above, through premixing chamber 5. The conversion of the reaction mixture occurs in zone C-3 which is located on support grate 7 and which, in addition, is cooled by heat exchanger 11 which is located below it. The wall temperature in reaction zone C-3 is monitored by wall temperature sensor 13.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION

1 Porous reactor
2 Zone A
3 Zone C
4 Zone B
5 Premixing chamber
6 Connection piece for temperature sensor
7 Support grate
8 Ceramic interior lining
9 Graphite walls
10 Steel outside walls
11 Heat exchanger
12 Cooling medium connection
13 Wall temperature sensor

What is claimed is:

1. A device for burning a fuel and oxidant mixture in a strongly exothermic reaction, the device comprising:

a reactor including at least one feed line for the fuel and the oxidant and a combustion chamber including at least one first porous material in a first zone and at least one second porous material in a separate second zone, said combustion chamber, said at least one first porous material and said at least one second porous material being formed from materials resistant to temperatures of approximately 1600° C. to 2400° C., said at least one second porous material having a sufficiently high heat capacity to restart a combustion reaction following a short-term interruption of gases, said first zone and said second zone configured such that the exothermic reaction can occur only in said second zone, said first zone being located before said second zone in a flow direction of the fuel and oxidant mixture and at a distance of between approximately 20 mm and 500 mm from said second zone, said distance of approximately 20 mm and 500 mm between said first zone and said second zone defining a third zone; and a support grate located at an interface area and configured to be cooled.

2. The device according to claim 1, further comprising a temperature monitoring device positioned in said third zone.

3. The device according to claim 2, further comprising an ignition device positioned in said third zone.

4. The device according to claim 2, wherein said temperature monitoring device is an infrared sensor.

5. The device according to claim 4, wherein the device is arranged vertically and said first zone is located above said second zone and said third zone.

6. The device according to claim 5, further comprising a premixing chamber for the fuel and oxidant mixture.

7. The device according to claim 6, wherein said premixing chamber is configured such that a flow speed of a component of the mixture in said premixing chamber in relation to a direction of said combustion chamber is greater than a flame speed in said combustion chamber.

8. The device according to claim 7, wherein said premixing chamber is cooled.

9. The device according to claim 8, wherein said first porous material and said second porous material are at least partially in the form of a plurality of bodies used in one of a bulk material of a filler body and random packing for a thermal separation process.

10. The device according to claim 1, wherein said combustion chamber is configured for flame stability during at least one of overpressure and negative pressure.

11. The device according to claim 10, wherein said combustion chamber is configured for a temperature equalization for an approximate adiabatic burning control without a thermal wall effect.

12. The device according to claim 11, further comprising a device for one of extraction and separation of reaction products from the fuel and oxidant mixture after burning.

13. The device according to claim 12, wherein the device is configured for one of chlorine and a chlorinated compound and one of hydrogen and a hydrogenated compound in the fuel and oxidant mixture for extraction of hydrogen chloride through combustion and further comprises a process technological device for extraction of one of hydrogen chloride and hydrochloric acid after said combustion chamber.

* * * * *